US005095729A

United States Patent [19]

Bundy

[11] Patent Number: 5,095,729

[45] Date of Patent: Mar. 17, 1992

[54] METHOD AND APPARATUS FOR REPAIRING A UNIBODY AUTOMOBILE CHASSIS

[76] Inventor: Douglas M. Bundy, 12268 N. Saginaw Rd., Clio, Mich. 48420

[21] Appl. No.: 525,089

[22] Filed: May 16, 1990

[51] Int. Cl.[5] ..... B21D 1/12

[52] U.S. Cl. ..... 72/308; 72/705

[58] Field of Search ..... 72/308, 422, 705; 294/93, 96

[56] References Cited

U.S. PATENT DOCUMENTS

| | | | |
|---|---|---|---|
| 1,259,640 | 3/1918 | Leake . | |
| 1,507,645 | 9/1924 | Wedgeworth . | |
| 2,931,416 | 4/1960 | Krise . | |
| 2,939,739 | 6/1960 | Grunsky . | |
| 3,986,383 | 10/1976 | Petteys . | |
| 4,589,180 | 5/1986 | Vachon . | |
| 4,591,200 | 5/1986 | Randen . | |
| 4,649,730 | 3/1987 | Butler | 72/705 |

OTHER PUBLICATIONS

Pages 214–230 Automotive Collision Estimating and Repair by Andre G. DeRoche.

*Primary Examiner*—Lowell A. Larson

*Attorney, Agent, or Firm*—Weintraub, DuRoss & Brady

[57] ABSTRACT

The apparatus disclosed is an attachment to be used in correcting misaligned rails in a unitized automobile chassis which includes a face plate to which is joined a three-piece wedge assembly. The apparatus allows as a result of wedging action, a sizable area of contact to be established between the apparatus and the interior of the misaligned rail so that when pulling force is applied to the apparatus, it is transferred to the rail through the broad area of contact thereby decreasing the chance of further damage to the rail during the repair process. Also disclosed is an embodiment featuring a two-piece wedge assembly. Methods for repairing a damaged rail using the wedge assemblies are also disclosed.

5 Claims, 2 Drawing Sheets

FIG.4
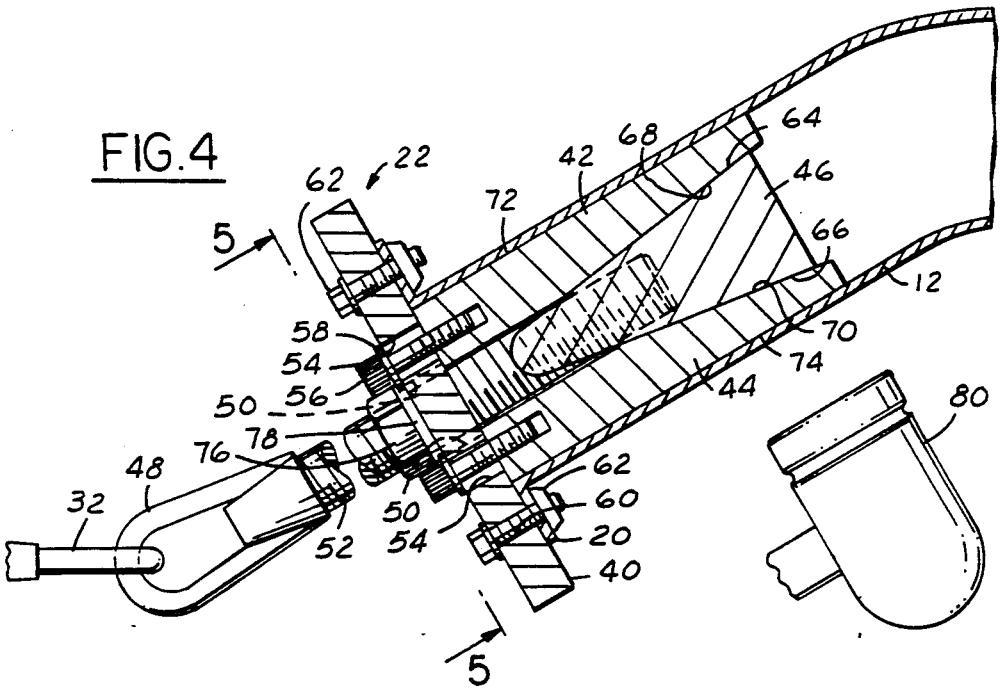
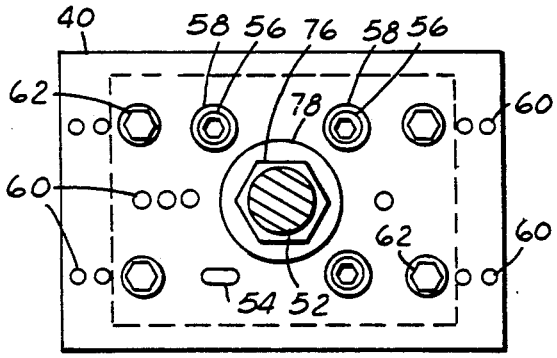
FIG.5
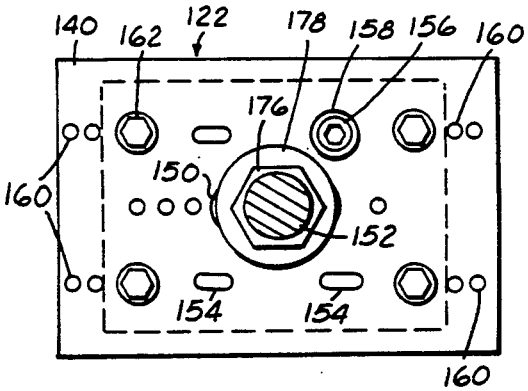
FIG.6
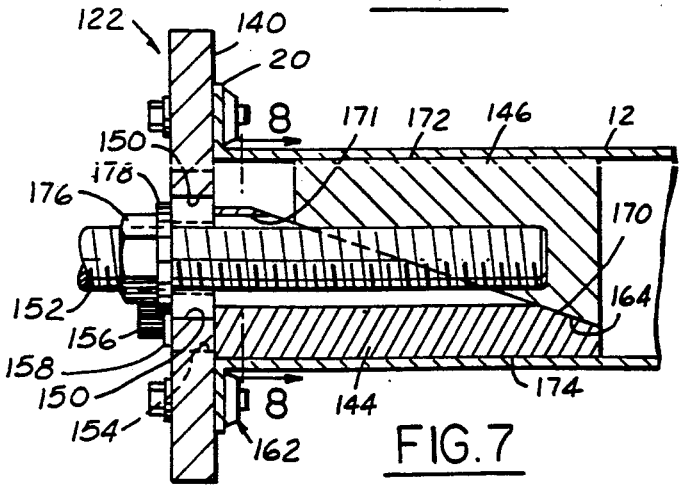
FIG.7
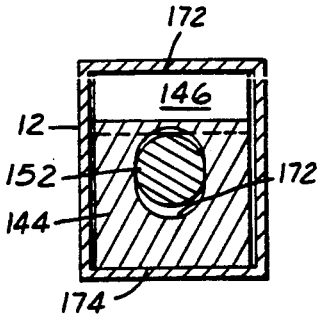
FIG.8

METHOD AND APPARATUS FOR REPAIRING A UNIBODY AUTOMOBILE CHASSIS

TECHNICAL FIELD

This invention relates to the repair of a unibody automobile chassis and more particularly to an apparatus and method to be used in repairing such a chassis.

BACKGROUND ART

Over the years, the types of frames used to support vehicle chassis have gone through transitions as better means have developed for giving lighter and safer constructions. In particular, a chassis construction referred to as the unitized body or unibody construction has been rapidly replacing the more conventional frame construction. In the uniframe construction, the frame members do not extend the full length of the body. They are shorter, have thinner wall thicknesses and are usually welded to the body itself. The under body section is reinforced to provide the floor with enough structural strength to replace portions of the side rail of conventional frames.

The unibody construction has developed several variations. In one type, every member is related one to the other so that all sections carry part of the load. Thus, the rocker panels, floor pans and other sections of the lower portion of the body are welded together to form a basic structure. The front of the structure where the engine and suspension are mounted is heavily reinforced and has the appearance of a separate frame except that the rails are not bolted, but welded to the body structure.

In some newer types of automobiles, in order meet the increasing demand for a better fuel mileage, yet maintain safety concerns, the vehicle has been further redesigned. The weight of the body has been reduced by using more plastics, high strength steels and aluminum. To meet continued safety concerns, the vehicles are designed with what is called a passive safety design which is specifically designed to absorb an impact as the vehicle crushes or bends. The manufacturers specifically design areas in the vehicle which are meant to bend and crush to absorb the energy of impact.

Although frame construction has changed markedly over the years, the basic idea behind frame alignment after a collision remain the same. Essentially, if a collision occurs which causes frame misalignment and damage, an attempt will be made to pull the frame back to its original position. Due to the use of lighter gauge metals throughout the unibody construction, it has been said that greater finesse is often needed during this activity. Excessive force may cause tearing and stretching of the frame members instead of correcting and straightening the damage.

In aligning the unibody frame after a collision, it is often necessary to pull directly on the thin walled box- or channel-type side rails. The attachment of the pulling chains is of particular concern to avoid the risk of tearing the steel. In the past, the chains used to pull the box or channel-type frame members into position have been attached to the pre-existing holes or flanges found on the members. In other cases, attempts have been made to grasp the outside of the box or channel-type members. These have not proved entirely satisfactory since they create narrow stress points which increase the likelihood of failure of the frame member.

DISCLOSURE OF THE INVENTION

An object of the present invention is to provide a method which allows easy attachment of the means for pulling box or channel-type frame members into position while decreasing the likelihood of damage to the box or channel-type member.

Another objection of the present invention is to provide a low-cost highly adaptable attachment that can easily and effectively be inserted into the box or channel-type frame members while providing a firm grasp of the member during the straightening process, and which can be used with standard frame straightening machines.

Accordingly, a method for repairing a unibody automobile chassis of the present invention is disclosed where the automobile body is secured and an attachment is placed within the rail. The attachment is then expanded until a sizable area of contact occurs between the tool and the interior of the rail. The rail is then pulled by applying a force to the rail through the contact area.

The apparatus of the present invention is designed for attachment to an open-ended tubular rail where engaging means are provided and when in an expanded state, creates a substantial area of contact with the interior of the rail so to allow transfer of a substantial portion of any pulling force applied to the engaging means tacked upon the rail. Also provided are means for moving the engaging means between such an expanded state and a compressed state where the attachment may be inserted or removed from the rail. Specifically disclosed is a wedge assembly where the wedge provides engaging means.

BRIEF DESCRIPTION OF THE DRAWINGS

FIG. 4 is the same as FIG. 3 with the attachment wedged in place;

FIG. 5 is a cross-sectional view taken along the line 5—5 of FIG. 4;

FIG. 6 is a view corresponding to FIG. 5 of a second embodiment of the attachment;

FIG. 7 is a cross-sectional view of a portion of the front side rail and the embodiment of FIG. 6 with the attachment wedged within the side rail taken along the line 3—3 of FIG. 2; and FIG. 8 is a cross-sectional view of the embodiment of FIG. 6 taken along the line 8—8 of FIG. 6.

BEST MODE FOR CARRYING OUT THE INVENTION

Figure 1:
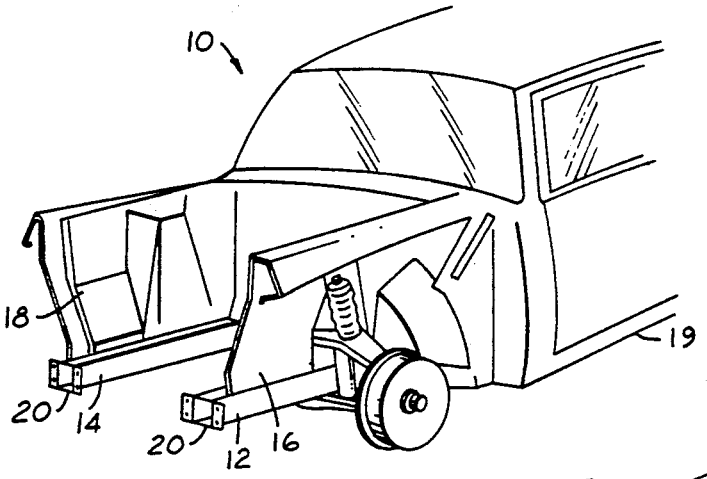
FIG. 1 is a perspective view of an automobile having a unibody construction with side panels, grill, motor, bumpers and related equipment being removed.

The portion of an automobile chassis featuring the unitized body or unibody construction is shown in FIG. 1. The portion of the chassis !0 shown has been stripped of the outer body panelling, the front bumper, engine, tires, and other related elements to better show the unibody construction. As shown in this particular chassis, the frame includes front side rails 12 and 14. Joined to the front side rails are cowls 16 and 18. Along the side of the passenger section are the rocker or sole panels 19. The front side rails 12 and 14 and similar side rails will have a box or channel type of cross-section as shown in FIG. 1. The rails may or may not feature flanges 20 which may be used to attach the bumper (not shown). More commonly now for shock absorbing purposes, an isolator (not shown) is usually inserted between the rail and the bumper assembly.

Figure 2:
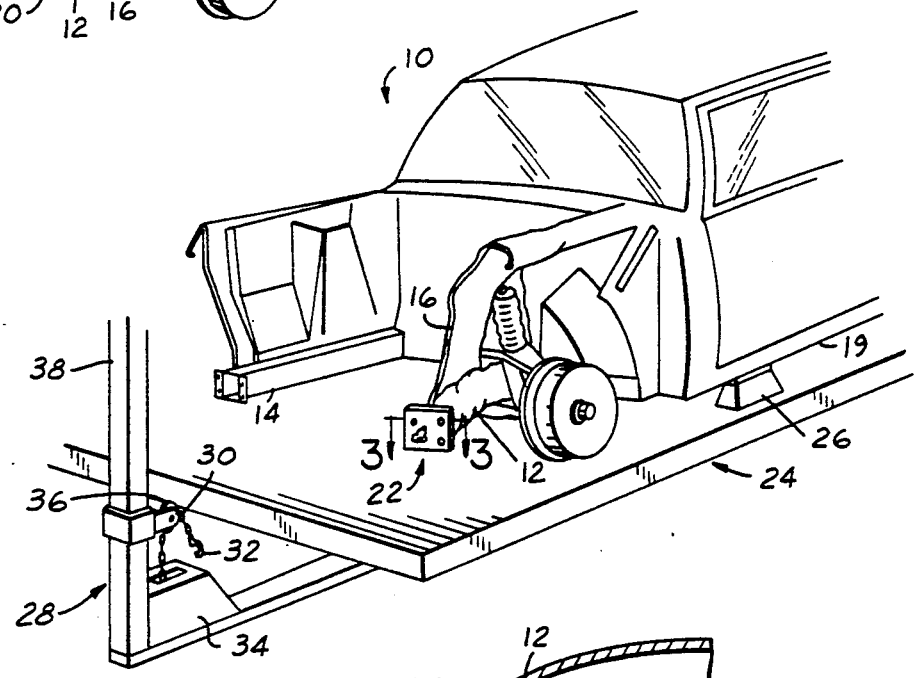
FIG. 2 is a perspective view of the vehicle of FIG. 1 positioned on a frame straightening machine after the vehicle has sustained damage to the front driver's side of the unibody with an embodiment of the attachment of the invention inserted in the damaged front side rail.

For purposes of describing the best mode, it is assumed that the automobile in FIG. 1 has been involved in an accident which has resulted in damage to the front of the automobile on the driver's side. This is shown in FIG. 2. In this particular example, the damage includes crumpling of the driver's side front side rail 12 and cowl 16. Such damage might also extend to the outer panel (not shown) and other elements of the car. Normally as few of the car elements are removed as possible prior to an attempt to straighten the car back to the original position. By doing this expensive labor time is saved. Due to the thin wall construction used in the unibody rails a, collision specialist may feel compelled to cut away the damaged portions of the front rail and other related damaged parts because of the current inability to obtain a consistent strong attachment of pulling tools to the rail. This then necessitates welding a new section rail and related components to the main chassis. This procedure takes significant amounts of time and is expensive.

The current invention provides an attachment 22 which is inserted in the damaged rail section 12. FIG. 2 shows the damaged chassis upon a dedicated bench body and frame straightener 24. The dedicated bench body and frame straightener is used in connection with the repair of unibody automobiles. The straightener is positioned with reference to blueprints supplied by the manufacturer so to allow restoring the damaged automobile to factory specification. The body and frame straighteners are generally designed and constructed for using the bench-weld flanges on the rocker or sole panels 19 on the automobile to tie it down and hold the vehicle on the straightener. A series of anchoring clamps are used to properly position and tightly secure the chassis to the straightener. One such clamp 26 is shown. Also attached to the straightener will be a series of pulling devices, one of which is shown at 28. Normally it will be necessary to pull the unibody frame a number of different directions, often at the same time. Only the particular pulling device 28 which will be connected to the front side rail by attachment 22 is illustrated. The importance of pulling at the precise correct angle cannot be overemphasized. That angle will be determined by the amount of damage and the specifications provided by the manufacturer. Often to correct severe damage, a particular body part such as a rail will need to be pulled several times in different directions to achieve the proper repair. Puller 28 includes a heavy chain 30 to one end of which is attached a hook 32. The other end of the chain is attached to a motor 34 which provides the power necessary to pull the body part to the desired position. In this particular pulling device, the chain goes around a pulley 36 to allow the chain to pulled from the proper direction. Proper vertical angle is controlled by movement of the pulley along post 38 while the horizontal direction of pull is controlled by positioning how the puller 28 is connected to straightener 24.

Figure 3:
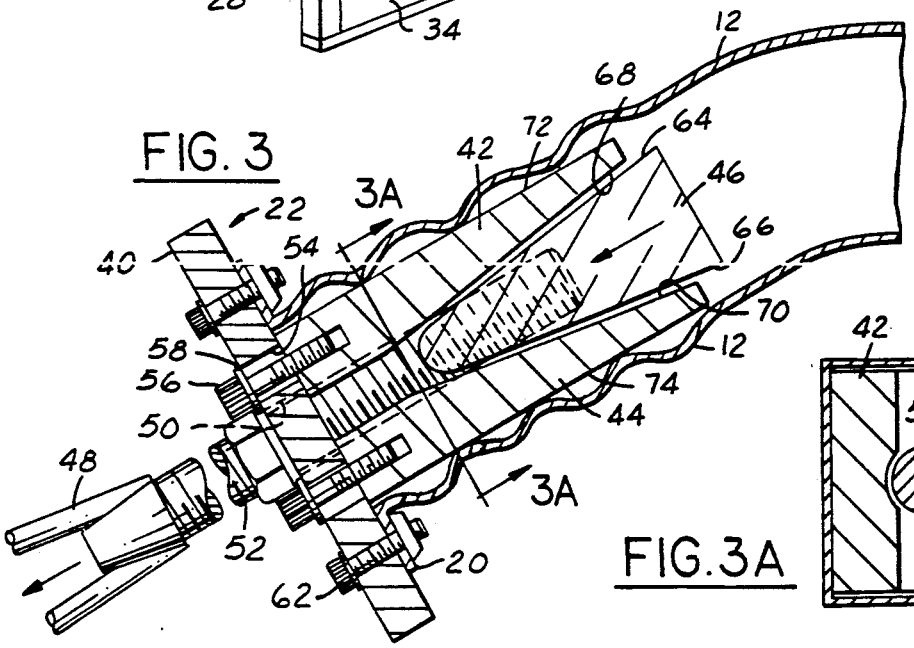
FIG. 3 is a cross-sectional top view of a portion of the front side rail and attachment taken along the line 3—3 prior to wedging of the attachment in place.
Figure 3A:
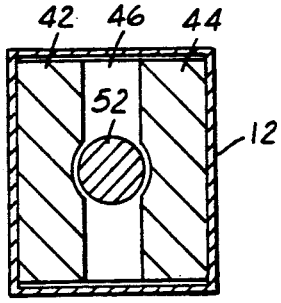
FIG. 3A is a cross-sectional view taken along the line 3A—3A of FIG. 3.

The details of one embodiment of attachment 22 are shown in FIGS. 3 through 5. The embodiment shown in these figures consists of a plate 40, a wedge assembly including three wedge members 42, 44 and 46, an eyelet 48 and a plurality of different nuts and bolts as will be more fully described below.

The face of plate 40 includes a large number of different sized holes. A central hole 50 allows for passage of wedge bolt 52. Slotted holes 54 provide the means by which wedge members 42 and 44 are joined to the plate by bolts 56 and washers 58. One bolt 56 and washer 58 is not shown in FIG. 5 to allow the shape of hole 54 to be seen. Finally, a series of holes 60 are scattered throughout the plate. Holes 60 are positioned to allow joining plate 40 by means of bolts 62 to a wide range of flanges 20 that might be found on different automobiles.

Attachment 22 features three cooperating wedge members. Side wedge members 42 and 44 are slidably attached to plate 40 by bolts 56. The bolts are sufficiently loose to allow movement within slots 54 and thus the side wedge members 42, 44 can move in a direction parallel to the face of the plate (or transverse to the elongated rail 12). The bolts prevent movement away from the plate (or longitudinally within the tube). The third wedge member 46 is designed to act as a separating member between the side wedge members. Separating member 46 is joined to eyelet 48 by wedge bolt 52. Separating member 46 has a pair of inclined surfaces 64, 66 which interact with corresponding inclined surface 68 on side member 42 and inclined surface 70 on side member 44. Parallel surfaces 72,74 are provided on the outer peripheral portion of side wedge members 42,44. These surfaces are substantially flat and each has a preferred surface area of 15 to 30 square inches. A positioning nut 76 and washer 78 combination may be placed around wedge bolt 52 between the eyelet and the plate.

An alternative embodiment is shown in FIGS. 7 and 8 by attachment 122. This attachment is also designed to fit within rail 12. A primary difference is that attachment 122 uses a wedge assembly including a pair of wedging members 144 and 146. This attachment has a plate 140, the face of which is shown in FIG. 6. The face of plate 140 features a large number of different size holes. A central slotted hole 150 allows for passage of wedge bolt 152. Slotted holes 154 provide the means through which wedge member 144 is joined to the plate by bolts 156 and washers 158. Only one bolt 156 and washer 158 is shown in FIG. 6 to allow the slot shape to be seen, although a pair would normally be used. A series of holes 160 are positioned to allow joining plate 140 by means of bolts 162 to a wide range of flanges 20.

The wedge assembly features two corporating wedge members. The bolts joining wedge member 144 to plate 140 are sufficiently loose to allow movement within slots 154 and thus wedge member 144 can move in a direction parallel to the face of the plate (i.e., transverse to the elongated rail 12). The bolts, however, prevent movement away from the plate (or longitudinally within the tube). The second wedge member 156 is joined to an eyelet (not shown) by wedge bolt 152. The eyelet is joined to the wedge bolt in the same manner eyelet 48 is joined to wedge bolt 52 in the previous embodiment. A slotted passage 171 is provided in wedge member 144 to allow wedge bolt 152 to pass through wedge member 144. Wedge bolt 152 also passes through slotted hole 150 and plate 140. The wedge members have abutting inclined surfaces 164, 170. The wedge members have parallel surfaces 172, 174 which are provided on the outer peripheral portions of the wedge members. These parallel surfaces are substantially flat and each has a preferred surface area of 15 to 30 square inches. A positioning nut 176 and washer 178 combination may be placed around wedge bolt 152 between the eyelet and the plate.

In operation, when confronted with a damaged front rail or the need to attach a pulling force to the rail, the mechanic will place the automobile on straightener 24 and secure it by means of clamps 26. Attachment 22 is then prepared for insertion within the rail. Eyelet 48 is moved towards plate 40 which causes wedge member 46 to move away from the plate. Side wedge members 42 and 44 can then be moved towards one another until the distance between their outer peripheral surfaces 72, 74 is sufficiently small to allow the wedge assembly to pass into the interior of rail 12. The attachment is then inserted into rail 12 until plate 40 abuts the end of rail 12. If rail 12 has a flange 20, attempts should be made to join the plate to the flange 20 with bolts 62 through appropriate holes 60.

Eyelet 48 is now pulled away from the plate which will result in the surfaces 64,66 of member 46 to move along surfaces 68,77 of the side wedge members 42, 44. This wedging action will cause the side wedge members to separate. Eyelet 48 is continued to be pulled until the outer peripheral surfaces 72, 74 of the side wedges contact corresponding surfaces on the interior of rail 12. Pulling force should be applied through pulling device 28 by placing hook 32 in eyelet 48 so that the peripheral surfaces of the side wedge members will deform any imperfections in the rail 12 such as shown in FIG. 3 until the imperfections are substantially smoothed out and a broad surface-to-surface contact between the side wedge members and rail 12 is established. These peripheral surfaces may also be used as anvils and a suitable tool such as mallet 80 can be used to pound out further deformities caused by the crash. Once a firm contact has been made between the outer peripheral surfaces of the side wedge members and rail 12, wedge bolt nut 76 may be tightened against face plate 40 to prevent inadvertent loosening of the wedge assembly.

Additional pulling force is then applied by pulling device 28 from a suitable direction to pull the rail to its desired position. A substantial component of the pulling force will be transferred through the outer peripheral surface areas of the wedge members to the rail. Due to the force being applied along a broad surface, the risk of tearing or otherwise damaging the rail is greatly decreased. After the rail is pulled to its desired position (which is usually beyond the desired final position due to the necessity to take into account springback of the metal), the pulling devices may be repositioned for further pulling of the rail or, if no further pulling of the rail is desired, the attachment may be removed. In removing attachment 22, wedge bolt nut 76 is moved back toward eyelet 48. This allows eyelet 48 to be pushed toward plate 40 and in turn, wedge separating member 46 to be pushed away from plate 40. This will allow side wedge members 42 and 44 to move towards one another. Once contact between the side wedge members is broken and any bolts 62 removed which may have joined plate 40 to attachment flange 22, the attachment may be removed from the rail.

The operation using attachment 122 is similar to that occurring in use of attachment 22. The automobile is clamped down in a similar manner and eyelet 148 is moved toward the plate so to move wedge member 146 away from the plate. This allows the other wedge member 144 to be moved toward the center of the plate until the distance between the outer peripheral surfaces 172,174 is small enough to allow the wedge assembly to pass into the interior of the rail.

Once positioned within the rail, eyelet 148 is pulled away from the plate which will cause a wedging action between the two wedged members. The distance between the outer peripheral surfaces will increase until there is a broad surface contact between the side wedge members and rail.

Additional pulling force is then applied to pull the rail to its desired position. After pulling is completed, attachment 122 is removed by pushing the eyelet toward the plate which will in turn, allow the distance between the peripheral surfaces of the wedge members to be decreased so to allow removal of the attachment.

While the best mode for carrying out the invention has been described in detail, those familiar with the art to which this invention relates will recognize various alternative designs and embodiments for practicing the invention as disclosed by the following claims.

What is claimed is:

1. An apparatus for attachment to an open-ended elongated tubular rail of a unibody vehicle chassis, the rail having a substantially rectangular cross-sectional shape, the apparatus comprising:

an expandable assembly having a plurality of outer peripheral surfaces for cooperation with the interior surface of the tubular rail, the outer peripheral surfaces being shiftable transversely relative to one another between a retracted position which allows the expandable assembly to be inserted into the rail, and an extended position in which the outer peripheral surfaces engage an internal surface of the tubular rail, the expandable assembly comprising at least a pair or wedge members having adjacent wedging surfaces: the first of said edge members being shiftable longitudinally from a first position corresponding to the expandable assembly's retracted position, to a second position corresponding to the expandable assembly's expanded position;

the adjacent wedging surfaces being inclined so that movement of the first wedge member in a direction from its first position to its second position causes its wedging surface to contact the wedging surface of the second wedge member so as to force an outer peripheral surface of the expandable assembly joined to the second wedge member to move transversely to the direction of movement of the first wedge member;

an attachment affixed to the expandable assembly to enable an external pulling force to be applied to the rail internal surface, by the expandable assembly outer peripheral surfaces, to allow movement of the rail to a desired position;

a platelike positioning member having a width greater than the rail and joined to the expandable assembly so that abutment of the positioning member with the flange at the open-end of the rail will limit the distance in which the expandable assembly is inserted within the rail; and means for rigidly joining the platelike positioning member to the flange at the end of the rail.

2. A method for moving a misaligned open-ended tubular rail of a unitized automobile body, comprising the steps of:

securing a portion of the body so it will remain stationary with respect to movement of the rail;

placing a tool within the rail and attaching the tool to a flange of the rail;

expanding the tool within the rail until a sizeable area of contact occurs between the tool and the interior of the rail; and pulling the rail to a desired position by applying a force to the rail through the flange and the contact area.

3. The method of claim 2, wherein the tool comprises two wedge members operatively connected along a wedge surface on each of the wedge members so that expansion of the tool occurs by pulling the first of said wedge members longitudinally within the rail toward the open end of the rail, redirecting the pulling force by means of the cooperating wedge surfaces so as to move the second wedge member transversely to the movement of the first wedge member within the rail until an outer peripheral surface of the second wedge member contacts the interior of the rail.

4. The method of claim 2, further comprising the step of moving the first wedge member longitudinally away from the open end of the rail so that the cooperating wedging surfaces allow the outer peripheral surface of the second wedge member to move inwardly thereby compressing the tool to a size sufficient to allow its removal from the rail.

5. An apparatus for attaching to an open-ended tubular rail, the rail being part of a vehicle structure, the apparatus comprising:

(a) a platelike positioning member which has at least two slots formed therethrough, and further which has a wedge bolt mounting hole formed therethrough to accommodate passage therethrough of a wedge bolt;

(b) a first wedge-shaped member having a narrow end which faces toward the positioning member and a wide end which faces away from the positioning member, the first wedge-shaped member having a hollow bore formed therein to receive a wedge bolt;

(c) a wedge bolt which passes through the wedge bolt mounting hole and which fits into the hollow bore to interconnect the positioning member and the first wedge-shaped member;

(d) a second wedge-shaped member having a narrow end which faces away from the positioning member and a wide end which faces toward the positioning member, the second wedge-shaped member having a threaded bore formed therein at the wide end thereof; the second wedge-shaped member having an inclined surface which rests against a surface of the first wedge-shaped member and further having an outer surface for contacting the interior of the rail;

(e) a third wedge-shaped member having a narrow end which faces away from the positioning member and a wide end which faces toward the positioning member, the third-wedge-shaped member having a threaded bore formed therein at the wide and thereof; the third wedge-shaped member being disposed adjacent the first wedge-shaped member on the opposite side thereof from the second wedge-shaped member, the third wedge-shaped member having an inclined surface which rests against the first wedge-shaped member and also having an outer surface for contacting the interior of the rail; and (f) a plurality of fasteners for passing through the slots of the positioning member and for threadably engaging in the threaded bores of the second and third wedge-shaped members to slidably attach the second and third wedge-shaped members to the positioning member;

wherein the slots of the positioning member constrain movement of the second and third wedge-shaped member to directions which are substantially transverse to the wedge bolt, and wherein the apparatus is adapted to make frictional contact with the interior of a rail along substantially the full length of the outer surfaces of the second and third wedge-shaped members in response to movement of the first wedge-shaped member toward the positioning member.

* * * * *